United States Patent [19]

Hoormann

[11] Patent Number: 4,625,852

[45] Date of Patent: Dec. 2, 1986

[54] COIN DETECTION AND VALIDATION MEANS AND METHOD

[75] Inventor: Ronald A. Hoormann, St. Peters, Mo.

[73] Assignee: Coil Acceptors, Inc., St. Louis, Mo.

[21] Appl. No.: 772,702

[22] Filed: Sep. 5, 1985

[51] Int. Cl.[4] ..... G07D 5/08

[52] U.S. Cl. ..... 194/317

[58] Field of Search ..... 194/317, 318, 319

[56] References Cited

U.S. PATENT DOCUMENTS

| | | | |
|---|---|---|---|
| 3,918,563 | 11/1975 | Schwippert et al. | 194/318 |
| 3,918,564 | 11/1975 | Heiman et al. | 194/318 |
| 3,918,565 | 11/1975 | Fougere et al. | 194/317 |
| 3,952,851 | 4/1976 | Fougere et al. | 194/317 |
| 3,966,034 | 6/1976 | Heiman et al. | 194/318 |
| 4,151,904 | 5/1979 | Levasseur et al. | 194/319 |
| 4,254,857 | 3/1981 | Levasseur et al. | 194/319 |
| 4,416,365 | 11/1983 | Heiman | 194/317 |
| 4,460,003 | 7/1984 | Barnes et al. | 194/317 X |
| 4,572,349 | 2/1986 | Furuya et al. | 194/318 |

*Primary Examiner*—F. J. Bartuska

*Attorney, Agent, or Firm*—Haverstock, Garrett & Roberts

[57] ABSTRACT

A coin validation circuit and method of operation thereof, including a memory having stored therein a data entry for each acceptable denomination, a validation control circuit, preferably including a microprocessor, operatively connected to the memory, a ringing circuit operatively connected to the validation control circuit and operable to produce damped wave output signals, and a monitor circuit operatively connected to the ringing circuit to respond to a particular predetermined damped wave output signal characteristic, the validation control circuit operable during a coin validation operation with respect to any one of the acceptable denominations to retrieve from the memory a predetermined data entry, to produce a conditioning signal corresponding to the retrieved predetermined data entry to effect a pre-conditioning of the ringing circuit in accordance therewith, and to thereafter produce a ring initiation signal, the ringing circuit responsive to such ring initiation signal to produce during a ringing time interval a damped wave output signal the characteristics of which are dependent, in part, both upon the particular pre-condition of the ringing circuit and upon any coin in the field of the ringing circuit, the damped wave output signal produced in response to such ring initiation signal having associated therewith the particular predetermined damped wave output signal characteristic if a coin of the particular acceptable denomination whose associated data entry was retrieved from memory and utilized to pre-condition the ringing circuit is in the field of the ringing circuit during the ringing time interval, regardless of the denomination of the coin submitted to examination or the particular acceptable denomination with respect to which the coin validation operation is conducted.

21 Claims, 8 Drawing Figures

COIN DETECTION AND VALIDATION MEANS AND METHOD

BACKGROUND OF THE INVENTION

This invention relates to a coin detection and validation means and method, and, more particularly, to a coin validation means for use in distinguishing between coins deposited in a coin-operated vending system, which means includes a variably controllable ringing circuit, and to a method of operation of such coin validation means.

It will be appreciated that, throughout this application, the term "coin" may be employed to mean any coin (whether valid or counterfeit), token, slug, washer, or other metallic object or item, and especially any metallic object or item which could be utilized by an individual in an attempt to operate a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

Over the years, a number of coin validation means, designed in accordance with various coin validation techniques for use in or with various coin handling systems, have been constructed and advantageously employed in many vending applications. For many years, most of such coin validation means were mechanical in nature and were designed to validate coins on the basis of the coins' physical shapes or sizes. In more recent years, coin validation means of electromechanical and electronic natures have been designed to replace or complement the purely mechanical coin validation means, some of which electomechanical and electronic coin validation means operate to validate coins on the basis of the coins' physical shapes and sizes, and others of which operate to validate coins based upon other characteristics of the coins.

Included among such coin validation means have been devices such as those disclosed in U.S. Pat. Nos. 3,870,137; 3,918,563; 3,918,564; 3,918,565; 3,952,851; 3,966,034; and 4,151,904, all of which devices employ inductors of known characteristics as part of an oscillator circuit. In such devices, an inductor is positioned to be affected by the presence of a coin in the vicinity thereof and to cause a change to occur in the oscillator output. Such changes have been used as a basis for detecting and distinguishing between different coins. Generally, such devices operate when a coin is present in the vicinity of the inductor to produce a measured or derived value representative of such coin, and thereafter operate in various ways to compare such measured or derived value against different predetermined values in order to determine whether or not such coin is a valid coin. For the most part, the greater the number of different predetermined values against which the measured or derived value is compared, the more circuitry, especially replicative circuitry, that has been required by coin validation means of these types. To some extent, however, it has been found possible to reduce the amount of replicative circuitry that would otherwise be required through the use of a programmable memory such as is called for by U.S. Pat. No. 3,918,565, which patent teaches that a coin validation means may be constructed to include a programmable memory to store the plurality of different predetermined values and a comparison means to compare the measured or derived value representative of the coin undergoing examination against the plurality of predetermined values stored in the programmable memory in order to determine whether or not the coin is a valid coin.

In recent years, it has become recognized, as disclosed in U.S. Pat. No. 4,254,857 and U.S. Pat. No. 4,460,003, that ringing circuits may be advantageously employed as coin detection and validation means in coin-operated systems. U.S. Pat. No. 4,254,857, which is assigned to a subsidiary of Applicant's assignee, teaches that it is possible, through utilization of a ringing circuit, to distinguish between various coins since the presence of different coins in the field of the ringing circuit at the time such circuit is shocked or pulsed effect different damped wave output signals. The damped wave output signals produced have certain distinctive characteristics of magnitude, frequency, and envelope dependent upon whether or not a coin or other metallic object is in the field of the ringing circuit and, if so, upon certain characteristics of the particular coin in such field and such coin's position within the field.

The present invention is an advancement beyond the coin detection and validation means of U.S. Pat. No. 4,254,857, and is designed to operate in such a fashion that a ringing circuit forming a part thereof is variably controllably conditioned prior to being shocked or pulsed so that the damped wave output signal thereafter produced when such circuit is shocked or pulsed will, if a valid coin of the denomination being checked is present in the field of the ringing circuit at such time, have a "standard" feature or characteristic that can be easily and readily detected and confirmed. Although such "standard" feature or characteristic could be associated with any of the magnitude, frequency, or envelope of the damped wave output signal, it has been found convenient, in one preferred embodiment of the invention, to utilize as a "standard" a pre-established threshhold number of cycles whose amplitudes exceed a pre-established value. Regardless of the particular coin denomination being checked, the pre-established amplitude value and the pre-established threshhold number of cycles whose amplitudes exceed such pre-established value remain the same. As a consequence thereof, such preferred embodiment does not require a large amount of replicative circuitry, even when a number of different coin denominations are to be checked, and also does not require a comparison means that must compare a measured or derived value associated with a coin undergoing examination against a plurality of predetermined coin validation values stored in a programmable memory.

Such preferred embodiment includes a validation control means, a memory means operatively connected to such validation control means to permit the retrieval therefrom of predetermined data stored therein, which data is associated with the different denominations of valid coins, ringing means operable under control of the validation control means, and a detector means operatively connected to the ringing means to permit the monitoring of damped wave output signals produced thereby, which detector means functions to provide to the validation control means information regarding the damped wave output signals produced by the ringing means. Preferably, the validation control means includes a programmed microprocessor, and the predetermined data stored in the memory means includes predetermined pairs of data entries, each of which pairs of data entries is associated with a respective coin denomination so that two coin acceptability sub-tests may be performed.

During a coin validation operation, the validation control means of such preferred embodiment operates, at appropriate times during the operation, to perform two coin acceptability sub-tests for each coin denomination to be checked, each of which sub-tests is effected by individually retrieving from the memory means a data entry associated with the respective coin denomination being checked and by providing to the ringing means a conditioning signal corresponding to such data entry, which conditioning signal establishes certain respective parameters relative to the ringing means. When the appropriate parameters for any particular data entry retrieved from the memory means have been established, the ringing means is then shocked or pulsed under control of the validation control means, and information regarding the particular damped wave output signal produced by the ringing means under such conditions is provided to the validation control means by the detector means. If, for such data entry, the information provided by the detector means indicates that the requisite "standard" features or characteristics for such sub-test have been detected, the coin present in the field of the ringing means is considered to have satisfied such sub-test. On the other hand, if the information provided by the detector means does not indicate that the requisite "standard" features or characteristics have been detected, the coin present in the field of the ringing means is considered to have failed such sub-test. If both sub-tests are satisfied, the coin is considered a valid coin; if either sub-test is failed, the coin is considered an invalid or unacceptable coin.

The present invention is thus designed to utilize a ringing circuit for distinguishing between valid and unacceptable coins and for distinguishing between valid coins of different denominations, and therefore realizes the benefits and advantages attendant to such use of a ringing circuit, but does so without the use of a large amount of replicative circuitry and without any necessity of making comparisons between a measured or derived value of the coin being tested and a plurality of coin validation values stored in a programmable memory. Optionally, such invention can be readily utilized in conjunction with other coin validation and verification means of various types and designs, whether such means be mechanical, electromechanical, or electronic in nature, and it has been found that such invention is particularly advantageous when employed in conjunction with and to complement various coin sizing means which operate to validate and verify coins based upon such coins' physical shapes and/or sizes.

In light of the foregoing comments, it will be recognized that a principal object of the present invention is to provide an improved means and method for validating coins or other metallic objects.

A further object of the invention is to provide an improved coin validation means that utilizes a ringing circuit.

Another object of the invention is to teach the construction and use of a coin validation means which produces, for all coin denominations to be checked, an output that has a standard feature or characteristic, regardless of which coin denomination is then being checked, if the coin undergoing examination is a valid coin of such coin denomination being checked.

An additional object of the invention is to provide a coin validation means that can be used to distinguish between a number of different coin denominations without the use of a large amount of replicative circuitry.

A further object of the present invention is to provide a coin validation means that can be used to distinguish between a number of different coin denominations without the necessity of making comparisons between a measured or derived value of the coin being tested and a plurality of coin validation values stored in a programmable memory.

A still further object of the present invention is to provide an electronic coin validation means that can be readily utilized in conjunction with other coin verification means.

Another object is to provide a coin validation means utilizing a microprocessor to control the operation of a variably controllable ringing circuit.

These and other objects and advantages of the present invention will become apparent after considering the following detailed specification in conjunction with the accompanying drawings, wherein:

DESCRIPTION OF THE PREFERRED EMBODIMENT

Figure 1:
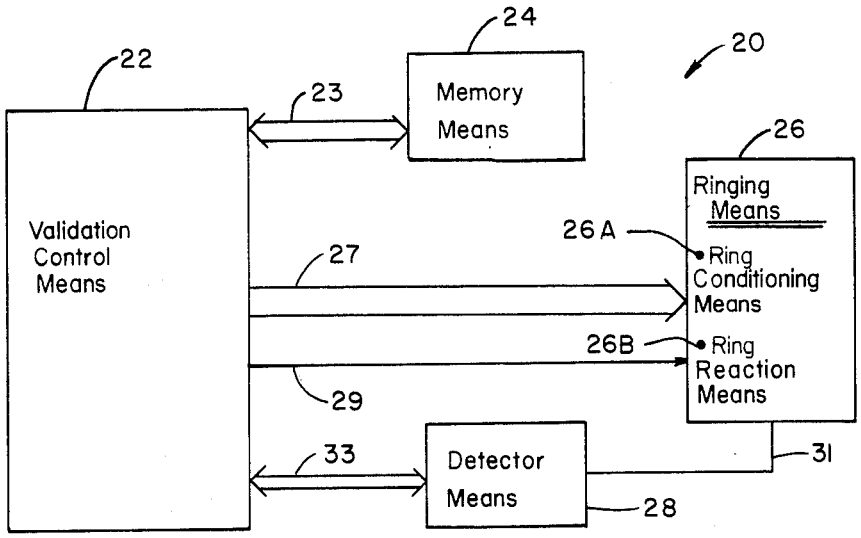
FIG. 1 is a block diagram depicting the major components of the invention.

Referring now to the drawings more particularly by reference numbers, wherein like numbers refer to like items, number 20 in FIG. 1 refers to a coin validation means constructed according to the present invention, which coin validation means includes a validation control means 22 operatively connected via a data/control link 23 to a memory means 24 to permit retrieval from such memory means of data stored therein. A ringing means 26, which includes ring conditioning means 26A and ring reaction means 26B, is operatively connected to the validation control means 22 via a data link 27 to permit such ringing means to receive conditioning signals produced by the validation control means, and is also operatively connected via a control link 29 to permit such ringing means to receive from the validation control means 22 ring initiation signals produced thereby. The ringing means 26 is responsive to such conditioning signals and ring initiation signals to produce damped wave output signals on output monitor lead 31. A detector means 28 is operatively connected to such monitor lead 31 in order to monitor the damped wave output signals produced by the ringing means 26 and to produce on data/control link 33 appropriate output signals representative of features or characteristics of such damped wave output signals. The validation control means 22 is operatively connected to receive the output signals produced by detector means 28 on data/control link 33, and is responsive to such signals to control further operations of the coin validation means 20. During a coin validation operation, the ring conditioning means 26A is responsive to the conditioning signal produced by the validation control means 22 to establish various parameters in the ringing means 26, and ring reaction means 26B is thereafter responsive to the ring initiation signal produced by the validation control means 22 to effect the production by said ringing means 26 of a damped wave output signal on lead 31.

Figure 2:
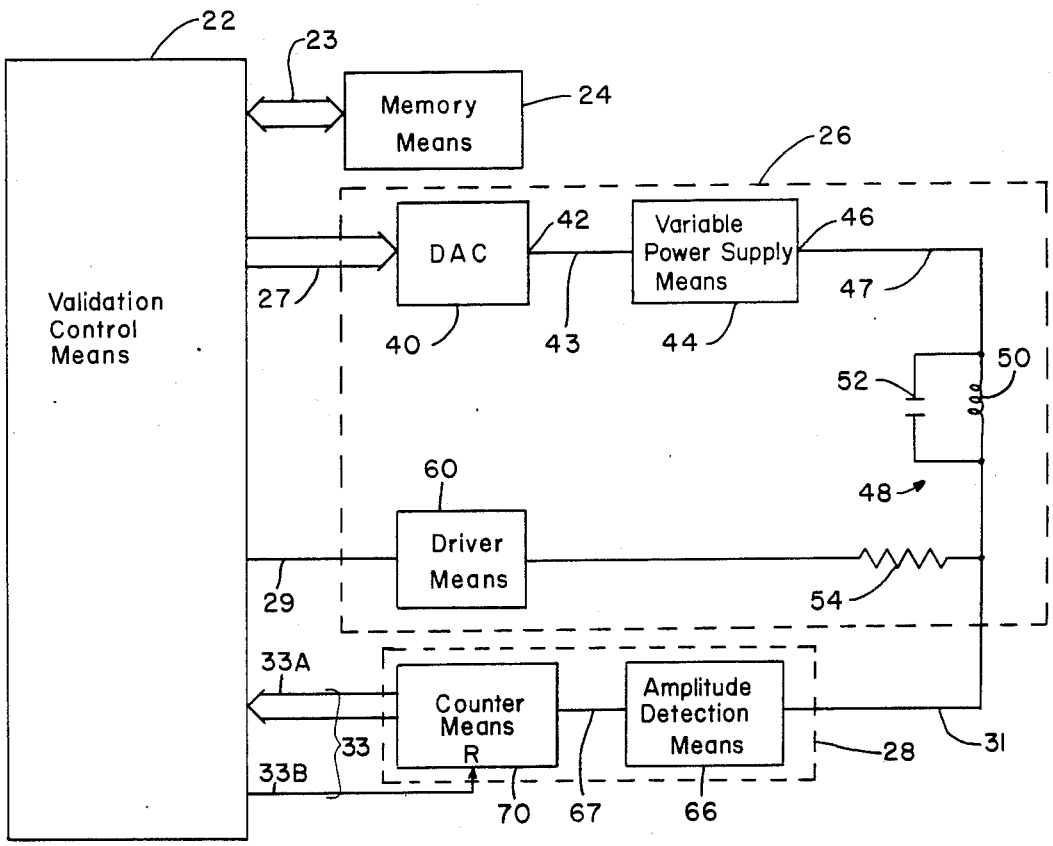
FIG. 2 is an illustration, in block diagram form, depicting in greater detail a preferred embodiment constructed in accordance with FIG. 1.

FIG. 2 depicts in block form a preferred embodiment of the present invention constructed in accordance with FIG. 1, showing greater detail in the constructional design of ringing means 26 and detector means 28. Ringing means 26 includes a digital-to-analog converter (DAC) 40 connected to receive conditioning signals produced on data link 27 by the validation control means 22, which digital-to-analog converter 40 includes an output 42 connected via lead 43 to a variable power supply means 44, at which output 42 are produced analog signals corresponding to respective digital conditioning signals provided as inputs to digital-to-analog converter 40 over data link 27. The variable power supply means 44 includes an output 46 which is connected via lead 47 to one side of a tank circuit 48 that includes an inductor 50 and a capacitor 52 connected in parallel, the other side of which tank circuit 46 is connected through resistor 54 to driver means 60 and also to detector means 28.

Driver means 60 is shown operatively connected to receive a ring initiation signal produced on control link 29 by the validation control means 22, and is responsive to such ring initiation signal to ensure that the tank circuit 48 is shocked or pulsed at such time, which action effects the production by ringing means 26 of a damped wave output signal on output monitor lead 31. Detector means 28 includes an amplitude detection means 66 and a counter means 70. The amplitude detection means 66 is shown operatively connected to output monitor lead 31 and is operable to produce on lead 67 a count signal whenever the amplitude of any cycle of the damped wave output signal produced by ringing means 26 exceeds a pre-established value. Counter means 70 is shown connected to lead 67 and is responsive to count signals produced on such lead by the amplitude detection means 66 to effect a count updating operation by such counter means. In the FIG. 2 embodiment the data/control link 33 between counter means 70 and validation control means includes a data bus 33A over which count information is provided from the counter means 70 to validation control means 22 and a control link 33B over which a reset or other control signal is provided from the validation control means 22 to counter means 70.

As has been explained in U.S. Pat. No. 4,254,857, assigned to a subsidiary of Applicant's assignee, amplitude detection means and counter means, such as the amplitude detection means 66 and counter means 70 of FIG. 2, may be readily employed with a shocked or pulsed ringing circuit to count the number of cycles of the damped wave output signal produced by such ringing circuit that exceed a predetermined value. As is explained in such patent, for a given ringing circuit having set values and parameters, the damped wave output signal produced at any time will be dependent upon whether or not any coin is in the field of the ringing circuit at the time the circuit is shocked or pulsed, and, if a coin is so present, upon the characteristics of the coin and the coin's position within the field. In the absence of any coin, the ringing circuit will produce a damped wave output signal, designated as an air signal. On the other hand, if a coin is positioned within the field of the ringing circuit at the time such circuit is shocked or pulsed, the ringing circuit will produce a different damped wave output signal, the features and characteristics of which will vary appreciably and significantly from the features and characteristics of the air signal. Those skilled in the art will recognize that the features and characteristics of such damped wave output signals are dependent not only upon the characteristics of the coins present in the field of the ringing circuit, but also upon the values of the components comprising the ringing circuit and the value of the voltage applied to the ringing circuit. It will thus be apparent that, for a given ringing circuit whose components have known values, the damped wave output signal producible thereby, for any particular coin, can be altered by changing the value of the voltage that is applied to the ringing circuit prior to the time such ringing circuit is shocked or pulsed, which change in value will result in a different charge being present upon the ringing circuit at the time it is shocked or pulsed. As will become more apparent from that which follows, such operational characteristics of ringing circuits have provided a basis for the design and operation of the present invention, and particularly for the design and operation of the embodiment of FIG. 2.

In such embodiment, a digital signal is provided from validation control means 22 over data link 27 to the digital-to-analog converter 40, which digital-to-analog converter produces a corresponding analog signal at output 42. Such analog signal is provided via lead 43 to variable power supply means 44, which power supply means operates in response to such analog input signal to supply at output 46 thereof a particular voltage corresponding to such analog input signal, and, therefore, also to the digital signal that was provided by validation control means 22 to the digital-to-analog converter 40. Such voltage at output 46 is supplied to the tank circuit 48 via lead 47 and acts to charge inductor 50 and capacitor 52 so long as the output of driver means 60 remains in a state that permits charging to occur. Subsequently, when a ring initiation signal is provided from validation control means to driver means 60 via lead 25, the driver means 60 will operate to interrupt the circuit of the inductor 50 in such a way as to ring or shock the inductor, thereby effecting production of a damped wave output signal on output monitor lead 31. The amplitude detection means 66 will monitor such damped wave output signal and provide to counter means 70 over lead 67 a count signal for each detected cycle of the damped wave output signal that exceeds a predetermined value. The counter means 70, which, is reset prior to or contemporaneously with the production by the ringing means 26 of the damped wave output signal, is responsive to such count signals to update the counter value, which value is made available to the validation control means 22 over data link 33A.

During a coin validation operation the validation control means 22, which preferably includes a microprocessor that operates under program control, acts to effect the retrieval from memory means 24 of data entries associated with the particular coin denominations to be checked, which data entries are used to produce digital data signals that are provided on data bus 27 to the digital-to-analog converter 40 in order to effect conditionings of ringing means 26. After the ring conditioning means 26A of ringing means 26 has properly responded to any of such digital conditioning signals so as to provide a corresponding, appropriate voltage at output 46 of variable power supply means 44 and to therefore effect appropriate charging of the inductor 50 and capacitor 52, the validation control means 22 will operate to produce a ring initiation signal on lead 25, as a consequence of which a damped wave output signal will be produced on output monitor lead 31, in the manner previously described, the features and characteristics of which damped wave output signal will determine whether or not a valid coin is then in the presence of the ringing means.

It has already been noted hereinbefore that the envelope of any particular damped wave output signal so produced on monitor lead 31 will be dependent, in part, upon the the value of the voltage provided at output 46 of the variable power supply means 44. Consequently, for a given set of conditions, it is possible, by a change in the value of the voltage provided at output 46, to effect a change in the envelope of the damped wave output signal produced. In light thereof, it will be appreciated that, if the given set of conditions is changed, which change would be expected to cause a change in some feature or characteristic, such as the envelope, of the damped wave output signal thereafter produced, the value of the voltage provided at output 46 can be correspondingly adjusted or changed so as to compensate for the change that might otherwise occur in the damped wave output signal produced. Thus, for coins of different denominations, the ringing means may be so conditioned that resulting damped wave output signals will have a standard feature or characteristic. Such conditioning in the present invention is controlled by the validation control means 22 and is dependent upon the particular data entries retrieved from memory means 24. In actual practice, it has been found desirable to utilize pairs of data entries, instead of only a single data entry, associated with each of the coin denominations to be checked, as a consequence of which two coin acceptability sub-tests can be effected in checking a subject coin for validity with respect to each coin denomination. In such practice, the ringing means is so conditioned during each sub-test that, regardless of the particular coin denomination being checked, the damped wave output signal produced will have a standard feature or characteristic if the coin undergoing examination is a valid coin of the particular coin denomination being checked.

As has already been indicated, the amplitude detection means 66 may be so designed that count signals will be produced on lead 67 whenever such amplitude detection means detects, in any damped wave output signal monitored, a cycle thereof whose amplitude exceeds a pre-established amplitude value. Due to the ability of the present invention to so condition the ringing means thereof prior to each time that such ringing means is shocked or pulsed so that the ringing means will produce a damped wave output signal which will have a standard feature or characteristic if the coin in the presence of the ringing means is a valid coin of the particular denomination being tested, and because more rapid damping of the damped wave output signals occurs when a coin is present in the field of the ringing means than when no coin is so present, it is possible to select the pre-established amplitude value such that, for first respective conditionings of the ringing means with respect to each different coin denomination to be checked, the damped wave output signal produced if a valid coin of the denomination being checked is in the field of the ringing means will have less than m cycles whose amplitudes exceed such pre-established amplitude value, and, for second respective conditionings of the ringing means with respect to each different coin denomination to be checked, the damped wave output signal produced if a valid coin of the denomination being checked is in the field of the ringing means will have at least m cycles whose amplitudes do exceed such pre-established amplitude value. The respective first and second conditionings of the ringing means with respect to each different coin denomination to be checked are effected in response to the conditioning signals provided to the ringing means 26 over data link 27 from the validation control means 22. As has previously been discussed, such conditioning signals are produced by the coin validation means 22 upon the retrieval from memory means 24 of respective predetermined data entries stored therein.

Figure 3:
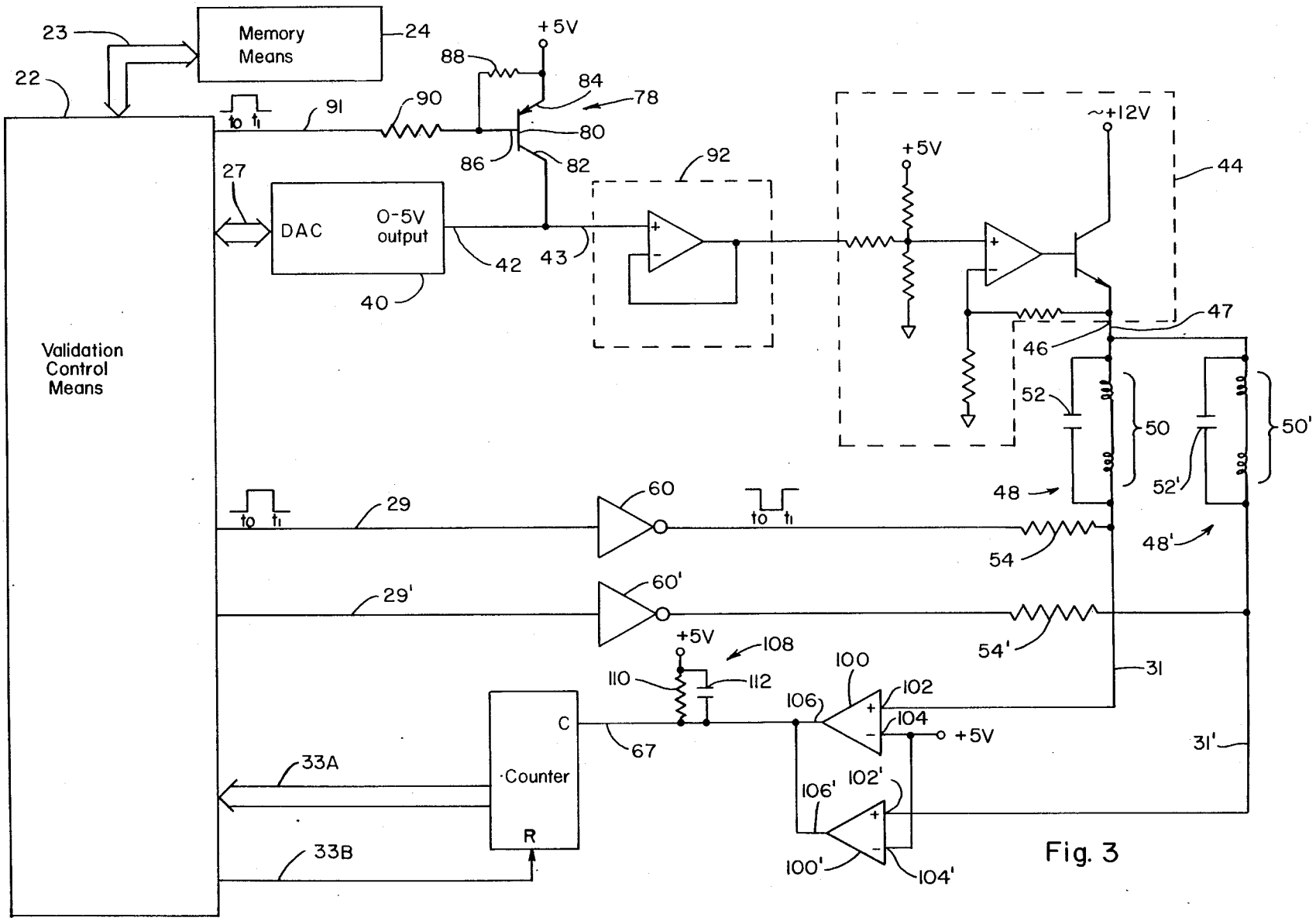
FIG. 3 is a schematic showing both typical circuitry that may be employed in the embodiment of FIG. 2 and optional enhancements to such embodiment, including an optional, second tank circuit and associated detector means.

FIG. 3 depicts an enhanced version of the preferred embodiment of FIG. 2, which enhanced version includes certain optional features not shown in FIG. 2, including an optional second tank circuit along with associated detector means, the purposes of which optional elements will become apparent in that which follows. The enhanced embodiment of FIG. 3 includes a DAC bypass circuit 78 that includes a PNP transistor 80 whose collector 82 is connected to the output 42 of the digital-to-analog converter 40, whose emitter 84 is connected to a +5 V. voltage source, and whose base 86 is connected through resistor 88 to the previously noted +5 V. voltage source and through resistor 90 to an input lead 91. It will be appreciated by those skilled in the art that such circuitry is operable such that application of a HI signal to lead 91 will gate transistor 80 OFF, as a consequence of which the output of digital-to-analog converter 40 will be dependent upon the digital data signal present on data link 27. However, if a LO signal is applied to lead 91, transistor 80 will then be gated ON, as a consequence of which the output of digital-to-analog converter 40 will be pulled up to approximately +5 V. The significance and purpose of such circuitry, though perhaps not readily apparent at this point in the discussion of the FIG. 3 embodiment, will become clearer as other circuit elements of such embodiment are discussed and the operation of such embodiment explained.

The output of the digital-to-analog converter 40 is provided to a voltage follower circuit 92, which may typically be constructed utilizing an LM324 low power operational amplifier, connected as shown, as the principal circuit element. Such voltage follower circuit acts as a buffer between the digital-to-analog converter 40 and the variable power supply means 44, and is connected to such variable power supply means 44, which may employ an LM324 low power operational amplifier 94 connected to other circuit elements in a typical power amplifier configuration, as shown, which configuration is well known to those skilled in the art, to control the voltage supplied at output 46 of the variable power supply means 44. In the enhanced embodiment here under discussion, the components employed and the values thereof have been so chosen that the analog signal present on lead 43, regardless of the condition of transistor 80, will fall within a range of approximately 0–5 V., and the voltage produced at output 46 of the variable power supply means 44 will fall within a range of approximately 2–7 V.

Such voltage supplied at output 46 of the variable power supply means 44 is provided to tank circuits 48 and 48', which tank circuits include respective inductor sets 50 and 50' and capacitors 52 and 52', each of which tank circuits is connected both to a respective output monitor lead 31 or 31' and through a respective resistor 54 or 54' to a respective driver means 60 or 60', which driver means may typically be ULN 2003 Darlington drivers whose inputs are connected to respective control links 29 and 29' to receive ring initiation signals produced by the validation control means 22. The output monitor leads 31 and 31' are respectively connected to positive (+) inputs 100 and 100' of voltage comparators 102 and 102', each of whose negative (−) inputs 104 and 104' are connected to a +5 V. voltage source and whose outputs 106 and 106' are connected through lead 67 to the count input (clock input) C of counter means 70. Such voltage comparators each function in such a manner that whenever the voltage present at the negative (−) input thereof is greater than the voltage present at the positive (+) input thereof, a LO output signal results. Typical of voltage comparator means that operate in such a manner are voltage comparators such as those included on LM339 chips. In order to effect proper operation of LM339 voltage comparators, the outputs thereof must be connected to a positive voltage source through a pull-up circuit so that whenever the voltage at the negative (−) input is less than the voltage at the positive (+) input, a HI signal will be ensured at the output. Consequently, the outputs 106 and 106' of voltage comparators 100 and 100' are shown connected through pull-up circuit 108, which includes a resistor 110 and capacitor 112 connected in parallel circuit with one another, to a +5 V. voltage source. Such circuitry ensures that the signal present on lead 67 will remain HI unless one or both of outputs 106 and 106' of voltage comparators 100 and 100' go LO at any time.

In light of the previous discusions herein, those skilled in the art will recognize that so long as a HI signal is present on control link 29 a circuit will remain established through tank circuit 48 thereby permitting the inductor set 50 and the capacitor 52 to be charged by the particular voltage then being supplied at output 46 of the variable power supply means 40. However, when a LO ring initiation signal is applied to such control link 29, the output of the inverting amplifier 60 will go HI, thereby causing the circuit through tank circuit 48 to be interrupted in such a manner that a damped wave output signal is produced on monitor lead 31, which damped wave output signal will ring about the value of the voltage then being supplied to the tank circuit. It has been found desirable, for circuit simplification and to avoid difficulties that might otherwise be encountered with regard to the establishment and maintenance of the pre-established amplitude value associated with the detector means 66, to supply a set or uniform voltage to the tank circuit during the time that damped wave signal outputs are actually being produced by the ringing means, regardless of the voltage value that was supplied to the tank under conditioning signal control while the elements of the tank circuit were being charged, so that all of such damped wave output signals will ring about the same voltage value. The DAC bypass circuit 78 permit such desirable operation of the variable power supply means 44. By providing a LO signal to lead 91 whenever a LO ring initiation signal is applied to either of the control links 29 or 29', and by otherwise maintaining the signal on such lead 91 HI, it is possible to control the variable power supply means 44 such that, during a charging or tank circuit conditioning interval, the voltage supplied at output 46 by such variable power supply means 44 is dependent upon the digital conditioning signal provided by the validation control means 22 over data link 27 to the digital-to-analog converter 40, whereas, during a ringing interval, the voltage supplied at output 46 is maintained at approximately +7 V., which supply voltage results from the production and maintenace during such ringing interval of an approximately +5 V. signal on lead 43.

In the foregoing presentation regarding the FIG. 3 embodiment, the discussion has centered around the ring inititiation signal provided by the validation control means 22 on control link 29, and the effect thereof upon tank circuit 48 and the circuitry associated therewith. It will be appreciated that tank circuit 48' and the circuitry associated therewith will act in a similar fashion if a ring initiation signal is provided to control link 29'. It has been found that the use of an optional second tank circuit 48' and associated circuitry, wherein the values of certain elements thereof differ from the values of corresponding elements of tank circuit 48 and its associated circuitry, is advantageous in many instances since the damped wave output signal produced by such second tank circuit 48' may, for a given conditioning signal and a particular coin undergoing examination, be of a different frequency than, but have other features or characteristics essentially the same as, the damped wave output signals produced by the first tank circuit 48. As is apparent from an examination of FIG. 3, the same counter means 70 may be employed with both of the tank circuits 48 and 48'. The utilization of such second, optional tank circuit and associated circuitry affords greater assurance of coin validity since the coin undergoing examination may be tested with respect to two different frequencies, instead of with respect to only single frequency.

Figure 4:
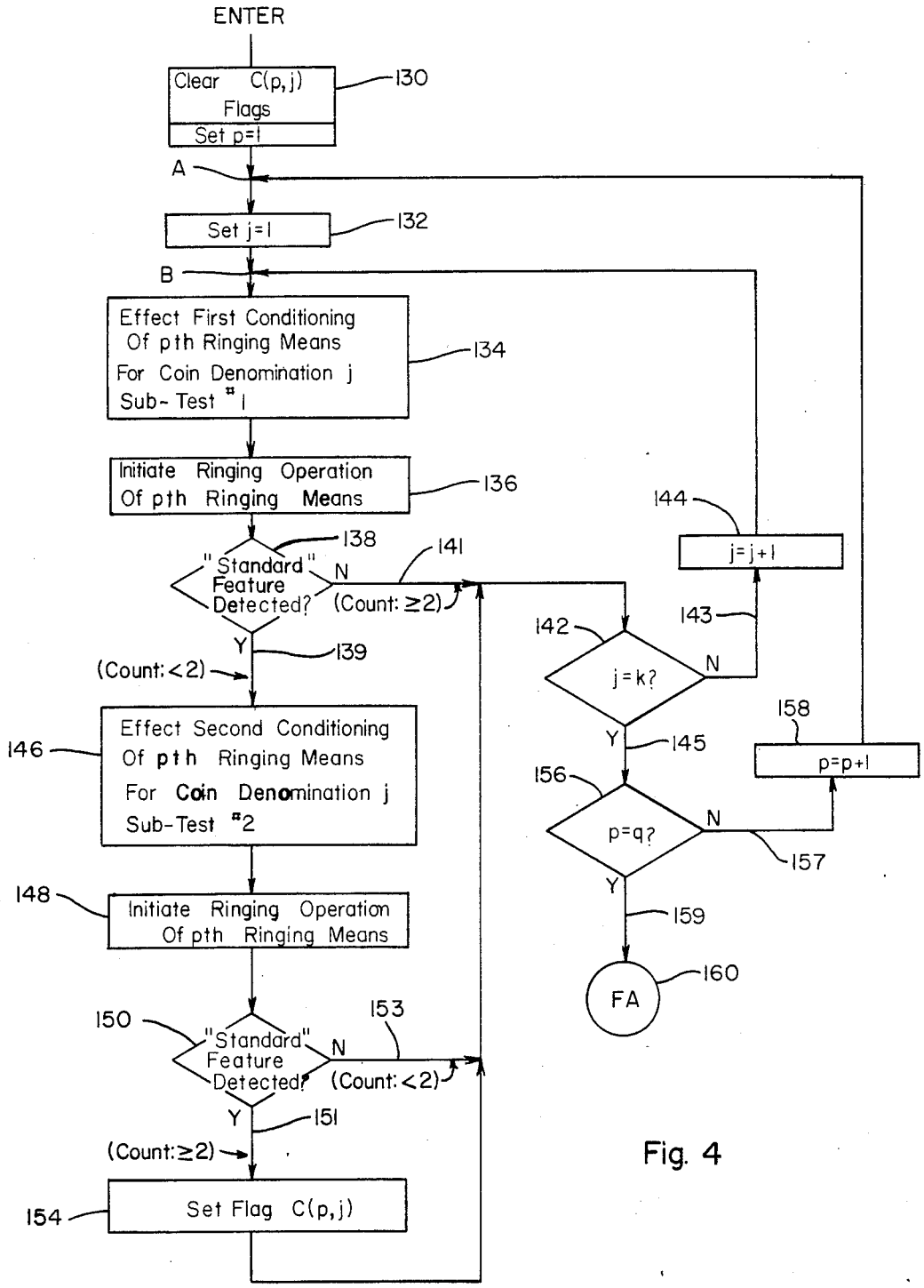
FIG. 4 is a flow chart depicting a typical operational sequence of an embodiment constructed generally in accordance with FIG. 3.

FIG. 4 depicts a typical operational sequence such as might be followed by the embodiment of FIG. 3. Such sequence is entered or initiated following a determination, which may be effected by any of various known means or techniques, that a coin has moved into a position within the field of the ringing means. Such sequence utilizes coin denomination flags C(p,j), for p=1 to q and j=1 to k, where q equals the total number of different tank circuits employed for coin validation testing according to the present method and k equals the total number of coin denominations to be checked, to denote whether or not the coin undergoing examination has been found, in a test involving tank circuit p, to be a valid coin of coin denomination j. The validation control means 22 initially operates, as denoted in block 130, to clear all the coin denomination flags C(p,j) and to set p=1. The operational sequence then proceeds through loopback entry point A to block 132, in accordance with which j is set equal to one (1).

Thereafter, the operational sequence proceeds through loopback entry point B to block 134, in accordance with which the validation control means operates to effect a first conditioning of the pth ringing means for coin denomination j. In the FIG. 3 embodiment, whose validation control means includes a programmed microprocessor, such conditioning operation may typically include the steps of retrieving from memory means 24 a first data entry for coin denomination j, producing on data link 27 a digital conditioning signal corresponding to such first data entry, and effecting resetting of the counter means 70 by way of a reset signal provided by the coin validation means 22 over control link 33B to the reset input R of counter means 70.

Subsequently, the validation control means will operate to initiate a ringing operation of the pth ringing means, as denoted in block 136, such as by producing a LO ring initiation signal on control link 29 and by applying a LO signal to lead 91. In the FIG. 3 embodiment, such actions will result in the production of a damped wave output signal and the entry into counter means 70 of a count associated with the damped wave output signal produced.

Following production of the damped wave output signal, the validation control means will operate in accordance with block 138 to check whether such damped wave output signal has had associated therewith the requisite standard feature or characteristic for the first coin acceptability sub-test. For the embodiment of FIG. 3, a check is performed to determine if less than two (2) counts have been entered in the counter means 70. If so, the coin is considered to have satisfied the first coin acceptability test, and the operational sequence will follow branch 139 from block 138. On the other hand, if two (2) or more counts are determined to have been entered in the counter means 70, the coin is considered to be an unacceptable or invalid coin of denomination j, and the operational sequence will follow branch 141 from block 138. It will be appreciated that numerous methods and means for performing such check exist and could be employed. By way of brief illustration only, and not by way of limitation, it may be noted that decoding and latching means such as are employed in the preferred embodiment of U.S. Pat. No. 4,254,857 could be utilized, as could other hardware means, which might include various arrangements of one-shots, multivibrators, and flip-flops, and that various techniques, such as examining the carry line from an adder to determine whether the addition of a predetermined value to the count in the counter means 70 generates a carry, could be advantageously utilized.

If the requisite standard feature or characteristic is not detected in the check performed at block 138, as a consequence of which the operational sequence proceeds along branch 141 from block 138, the validation control means will operate, as denoted in block 142, to check whether j=k, that is, whether all k coin denominations have been checked. If not, the operational sequence will follow branch 143 from block 142, and the value of j will be incremented by one (1), as denoted in block 144, following which the operational sequence will loop back and re-enter the previously described sequence at loopback entry point B. In such event, the operational sequence will then proceed in the same manner as has already been described, but with respect to the next coin denomination to be checked. On the other hand, if, in the check performed at block 142, j is found to be equal to k, indicating that all k coin denominations have been checked with respect to the pth ringing means, the operational sequence will follow branch 145 instead of branch 143 from block 142, the consequences of which will be discussed at a later point hereinafter.

Returning now to block 138, if the standard feature or characteristic is detected in the check performed thereat, as a consequence of which the operational sequence follows branch 139 from block 138, the validation control means will operate, as denoted in block 146, to effect a second conditioning of the pth ringing means for coin denomination j, and, as denoted in block 148, to initiatiate a ringing operation of the pth ringing means, which actions can be effected in a manner similar to that discussed hereinbefore with reference to blocks 134 and 136. Once a damped wave output signal is then produced and the count associated with such damped wave output signal entered into counter means 70, the validation control means will check, as denoted in block 150, to determine if the requisite standard for a second coin acceptability sub-test has been detected. In the embodiment of FIG. 3, a check is performed to determine if at least two (2) counts have been detected. If so, the coin is considered to have satisfied the second coin acceptability sub-test for coin denomination j, and the operational sequence will follow branch 151 from block 150. On the other hand, if less than two (2) counts are detected, the coin is considered to be an unacceptable or invalid coin of coin denomination j, and the operational sequence will follow branch 153 from block 150.

If the requisite standard feature or characteristic is not detected in the check performed at block 150, as a consequence of which the operational sequence proceeds along branch 153 from block 150, a check will be performed, as denoted in block 142, to determine whether j=k, that is, whether all k coin denominations have been checked. As has previously been discussed, depending upon the result of the check performed in accordance with block 142, the operational sequence will either return to loopback entry point B after updating the value of j, which procedure has been described hereinbefore, or follow branch 145, the consequences of which have been and presently continue to be deferred for later discussion.

Returning now to block 142, if the requisite standard feature or characteristic is detected in the check performed at block 150, as a consequence of which the operational sequence follows branch 151 from block 150, the validation control means will operate, as denoted in block 154, to set the coin denomination flag C(p,j), in accordance with which the operational sequence will then proceed to block 142, and a check will be performed, as has previously been discussed, to determine if j=k, that is, whether all k coin denominations have been checked. As has previously been described, depending upon the result of the check performed in accordance with block 142, the operational sequence will either return to loopback entry point B after updating the value of j, which procedure has been described hereinbefore, or will follow branch 145.

If branch 145 is followed, because j has been found to be equal to k, a check will then be performed, as denoted in block 156, to determine whether p equals q, that is, whether checks have been completed with respect to all q of the ringing means. If not, the operational sequence will follow branch 157 and the value of p will be incremented by one (1), as denoted in block 158, following which the operational sequence will loop back and re-enter the previously described sequence at loopback entry point A. In such event the operational sequence will then proceed in the same manner as has already been described, but with respect to the next ringing means that will be employed to produce damped wave output signals. On the other hand, if in the check performed at block 156, p is found to be equal to q, indicating that testing has been completed with respect to all q of the ringing means, the operational sequence will follow branch 159 from block 156 and further operations will be effected in accordance with a flag analysis routine FA, as denoted by subroutine block 160, appropriate for the particular invention embodiment employed and for the particular coin-operated system with which such embodiment is utilized.

It will be readily understood that, with the embodiment of FIG. 3, it is preferred that a coin be considered a valid coin of a particular denomination $j=1$ only if all q of the coin denomination flags C(p,l), for $p-1$ to q, have been set, i.e., only if all q sub-tests of the coin with respect to denomination 1 have been successfully passed. Generally, if any of the sub-tests has been failed, i.e., if the coin denomination flag associated with any particular sub-test has not been set, the coin will be considered an invalid or unacceptable coin of denomination 1. It will be recognized, however, that the flag analysis routine employed in any particular situation will necessarily be dependent upon the constructional and operational details of the particular invention embodiment being utilized, and that, in some instances, certain flag analyses routines may therefore be designed to recognize a coin as a valid coin of a particular denomination 1 even if not all q coin denomination flags C(p,l), for $p=1$ to q, have been set, or perhaps even if only certain ones of such coin denomination flags have been set.

It will be appreciated by those skilled in the art that the operational sequence depicted in FIG. 4 may be simplified if only one tank circuit is employed. Likewise, it will be recognized that, in some instances, it may be found desirable to conduct only one, instead of two, coin acceptability sub-tests with a particular tank circuit, as a consequence of which the operational sequence depicted could be simplified.

Figure 5:
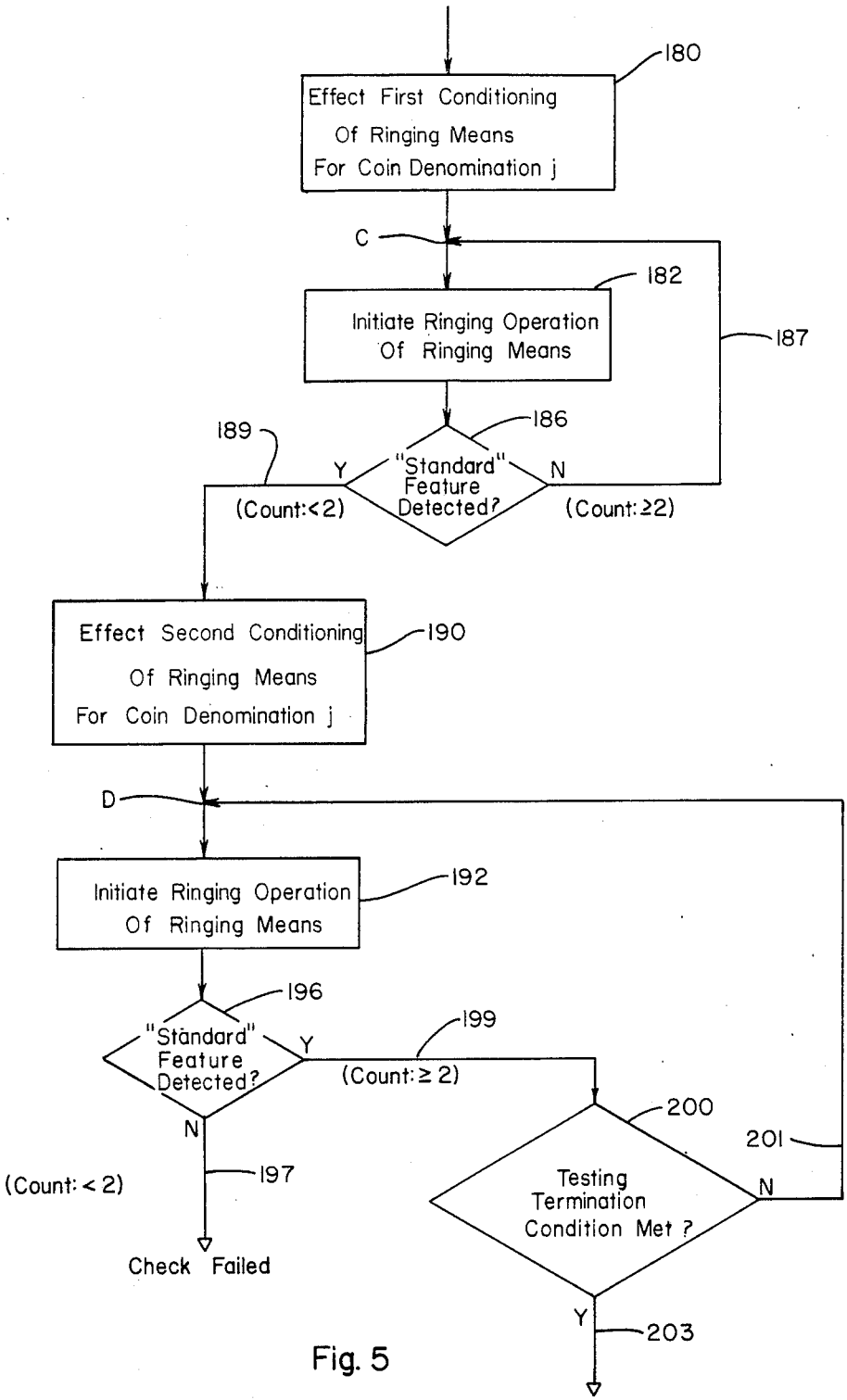
FIG. 5 is a simplified flowchart depicting in a streamlined fashion a portion of an operational sequence that could be employed by certain embodiments of the invention to test for coin presence in the field of the ringing means in conjunction with validation testing.

It will also be appreciated that, in some instances, it may be desirable to forego the use of separate means for detecting when a coin to be examined is properly positioned in the field of the ringing means and to instead utilize the present invention itself for such purpose. A simplified flow chart illustrating the manner in which an embodiment of the present invention could be so employed is depicted in FIG. 5. Upon initiation of the coin validation operation, the validation control means operates, as denoted in block 180, to effect a first conditioning of a ringing means for coin denomination j, which conditioning is effected by the production of a voltage at the output of the variable power supply means, which voltage corresponds to a lower limit data entry for coin denomination j retrieved from the memory means by the validation control means. Once such conditioning has been effected, the operational sequence proceeds through loopback entry point C to block 182, in accordance with which the validation control means initiates a ringing operation, which ringing operation may be effected in a manner similar to that previously described herein.

Thereafter, when the damped wave output signal has been produced and a count associated with such damped wave output signal entered in the counter means, a check is performed, as denoted in block 186, to determine whether the requisite standard feature for the lower limit data entries has been detected. In this particular instance, the determination is effected by checking whether a count of less than two has been entered in the counter means. A count of greater than or equal to two is an indication that a coin has not reached the field of the ringing means. In such event, the operational sequence will follow branch 187 to loopback entry point C, and operation will continue in a looping sequence through block 182, block 186, and branch 187 until, in the check performed in accordance with block 186, a count of less than two is detected.

When a count of less than two is detected in the check performed in block 186, it is known that a coin has entered the field of the ringing circuit, and the operational sequence follows branch 189 from block 186 to block 190. The validation control means then operates to effect a second conditioning of the ringing means, which conditioning is effected by producing a voltage at the output of the variable power supply, which voltage corresponds to an upper limit data entry for coin denomination j retrieved from memory means by the validation control means. Thereafter, the operational sequence proceeds through loopback entry point D to block 192, in accordance with which the validation control means initiates a ringing operation, which may be effected in a manner similar to that previously described.

When the damped wave output signal has been produced and the count associated therewith entered into the counter means, a check will be performed, as denoted in block 196, to determine whether the requisite standard feature for the upper limit data entries has been detected. In this particular instance, the determination is effected by checking whether a count of at least two has been detected. If less than two counts have been detected, the coin in the field of the ringing means fails the check for coin denomination j, and the operational sequence follows branch 197 from block 196. On the other hand, if a count of at least two has been detected in the check performed at block 196, the operational sequence follows branch 199 to block 200, in accordance with which a check is performed to determine whether or not testing termination conditions have been met.

Various methods may be employed for performing the check denoted in block 200, a few of which will be discussed hereinafter. Regardless of the particular method utilized, if a determination is made that testing should not be terminated, the operational sequence will follow branch 201 back to loopback entry point D, and the operational sequence will thereafter continue looping through block 190, block 192, block 196, branch 199, block 200, and branch 201, until a determination is made in accordance with block 200 that testing should be terminated. If a determination is made in the check performed in block 200 that testing should be terminated, the coin which has undergone examination is considered to be a valid coin of denomination j, and the operational sequence follows branch 203 from block 200.

In one arrangement, the check performed in block 200 may include a time check so established that termination of testing will be effected prior to the time the coin undergoing examination passes out of the field of the ringing means. In another arrangement, the check performed in block 200 may include the steps of effecting a third conditioning of the ringing means, based upon data of a lower value than the lower limit value of the coin denomination j being tested effecting a ringing operation, and checking to determine if a count of at least two with respect to the resulting damped wave output signal has been detected. If the count is less than two, the second conditioning of the ringing means for coin denomination j can be re-effected and the operational sequence can follow branch 201 in FIG. 5; if the count is at least two, the operational sequence can follow branch 203. Various other manners of effecting the check required by block 200 may also be utilized.

Figure 6:
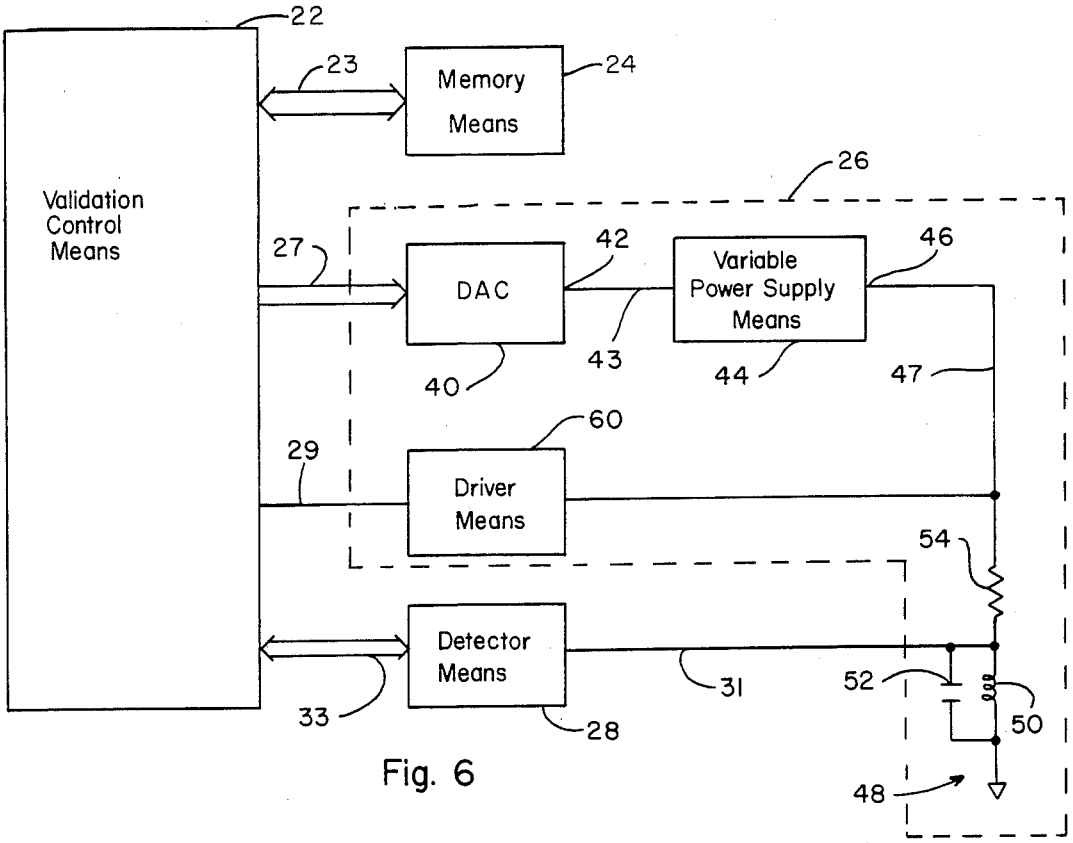
FIGS. 6–8 are block diagrams of various illustrative alternative embodiments according to FIG. 1.
Figure 7:
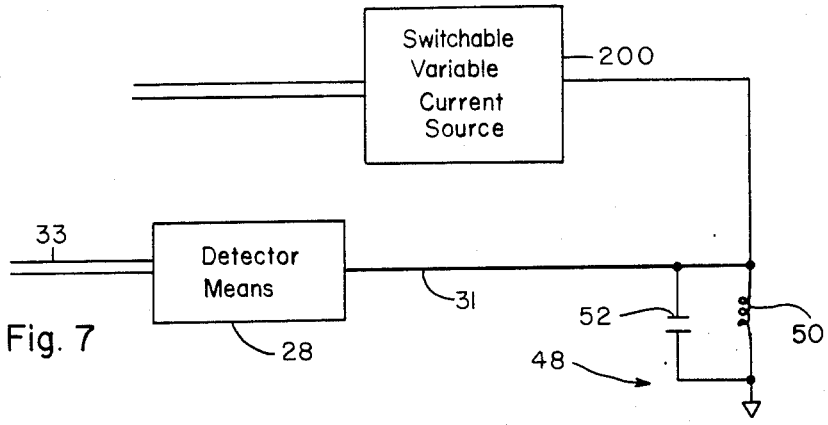
Figure 8:
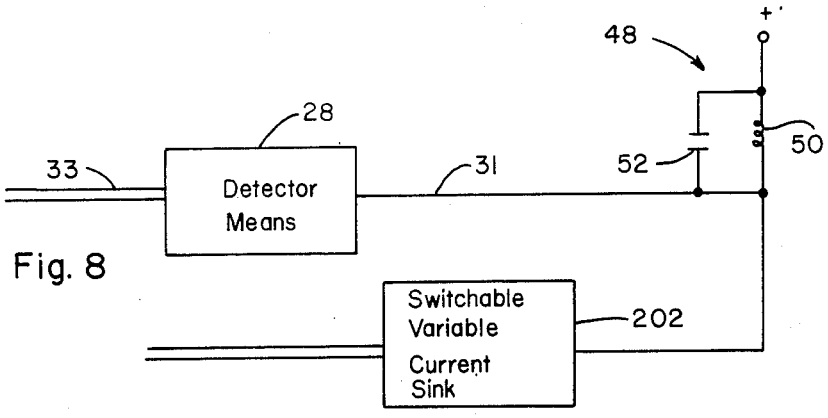

FIGS. 6–8 identify several other possible embodiments of the invention, which embodiments are offered for illustrative purposes only, and not by way of any limitation. The embodiment of FIG. 6 is similar in many respects to the embodiment of FIG. 2, but shows a different interconnection between various of the components of the ringing means 26. FIG. 7 illustrates that ring conditioning means 26A may include, instead of a variable power supply means 44, a switchable variable current source 200, and FIG. 8 illustrates that the ring conditioning means 26A may include, instead of a variable power supply means 44, a switchable variable current sink 202. From such illustrations and the discussions presented hereinbefore, especially the discussions regarding the embodiments of FIGS. 2 and 3, those skilled in the art will recognize and appreciate that many embodiments of the present invention could be constructed in accordance with the design of FIG. 1, and that many changes and modifications can be made to the particular embodiments discussed herein, without departing from the spirit and scope of the invention.

From all that has been said, it will be clear that there has been shown and described herein a coin validation means and method which fulfills the various objects and advantages sought therefor. It will be apparent to those skilled in the art, however, that many changes, modifications, variations, and other uses and applications of the subject coin validation means and method are possible and contemplated. All changes, modifications, variations, and other uses and applications which do not depart from the spirit and scope of the invention are deemed to be covered by the invention, which is limited only by the claims which follow.

What is claimed is:

1. A coin validation means for validating that a coin submitted to examination is a valid coin of an acceptable denomination, comprising a memory means including means for storing predetermined data entries, each acceptable denomination having a first data entry associated therewith, the corresponding first data entries for the respective acceptable denominations forming a first set of data entries, a validation control means operatively connected to said memory means and operable to permit the retrieval from said memory means of the predetermined data entries stored therein, ringing means operatively connected to said validation control means and controllable by said validation control means, said ringing means having a field associated therewith and including ring conditioning means and ring reaction means, said validation control means operable to produce respective conditioning signals corresponding to different predetermined data entries retrieved from said memory means, said ring conditioning means responsive to each conditioning signal to pre-condition said ringing means in accordance therewith, said validation control means operable to produce ring initiation signals, said ring reaction means responsive to each said ring initiation signal to produce during a ringing time interval a damped wave output signal the characteristics of which are dependent, in part, both upon the particular pre-condition of said ringing means and upon any coin in the field of said ringing means, and means operatively connected to said ringing means to monitor each said damped wave output signal and to respond to a first particular predetermined characteristic of said damped wave output signal applicable with respect to all of said first set of data entries, the particular damped wave output signal produced in response to any given ring initiation signal for any of said first set of data entries while a coin submitted for examination is in the field of the ringing means having associated therewith said first particular predetermined characteristic if such coin is a valid coin of the particular acceptable denomination whose associated first data entry was retrieved from said memory means and utilized to pre-condition said ringing means.

2. The coin validation means of claim 1 wherein said means operatively connected to said ringing means to monitor each said damped wave output signal includes a detector means operable to produce and to communicate to said validation control means an output signal.

3. The coin validation means of claim 2 wherein said detector means includes amplitude detection means operable to produce a count signal each time a cycle of any damped wave output signal exceeds a predetermined amplitude value, and counter means operatively connected to said amplitude detection means to receive said count signals produced by said amplitude detection means and to enter therein for each damped wave output signal produced a count equal to the number of cycles of the damped wave output signal which exceed said predetermined amplitude value.

4. The coin validation means of claim 3 wherein, for said first set of data entries, the count entered in said counter means as a result of a damped wave output signal is less than a predetermined threshhold count if a valid coin of the particular acceptable denomination whose associated data entry was retrieved from said memory means and utilized to pre-condition said ringing means was in the field of said ringing means during the ringing time interval.

5. The coin validation means of claim 1 wherein each acceptable denomination has a second data entry associated therewith, the corresponding second data entries for the respective acceptable denominations forming a second set of data entries, and wherein said means operatively connected to said ringing means to monitor each said damped wave output signal is responsive to a second particular predetermined characteristic of said damped wave output signal applicable with respect to all of said second set of data entries, the particular damped wave output signal produced in response to any given ring initiation signal for any of said second set of data entries while a coin submitted for examination is in the field of the ringing means having associated therewith said second particular predetermined characteristic if such coin is a valid coin of the particular acceptable denomination whose associated second data entry was retrieved from said memory means and utilized to pre-condition said ringing means.

6. The coin validation means of claim 5 wherein said means operatively connected to said ringing means to monitor each of said damped wave output signals includes amplitude detection means operable to produce a count signal each time a cycle of any damped wave output signal exceeds a predetermined amplitude value, and counter means operatively connected to said amplitude detection means to receive said count signals produced by said amplitude detection means and to enter therein for each damped wave output signal produced a count equal to the number of cycles of the damped wave output signal which exceed said predetermined amplitude value, and wherein, for said first set of data entries, the count entered in said counter means as a result of a damped wave output signal is less than a predetermined threshhold count if a valid coin of the particular acceptable denomination whose associated first data entry was retrieved from said memory means and utilized to pre-condition said ringing means was in the field of said ringing means during the ringing time interval and, for said second set of data entries, the count entered in said counter means as a result of a damped wave output signal is greater than or equal to a predetermined threshhold count if a valid coin of the particular acceptable denomination whose associated second data entry was retrieved from said memory means and utilized to pre-condition said ringing means was in the field of said ringing means during the ringing time interval.

7. The coin validation means of claim 1 wherein said ringing means includes a tank circuit and means for varying circuit conditions relative to said tank circuit.

8. The coin validation means of claim 7 wherein said means for varying circuit conditions relative to said tank circuit includes a means to establish a charging circuit through said tank circuit during a pre-conditioning time interval and other means to interrupt such charging circuit and to thereby cause said tank circuit to enter a ringing state.

9. The coin validation means of claim 8 wherein said means to establish a charging circuit through said tank circuit includes a variable power supply means.

10. The coin validation means of claim 8 wherein said means to establish a charging circuit through said tank circuit includes a variable current source.

11. The coin validation means of claim 8 wherein said means to establish a charging circuit through said tank circuit includes a variable current sink.

12. The coin validation means of claim 1 wherein said validation control means includes a programmed microprocessor.

13. A coin validation means for validating that a coin submitted to examination is a valid coin of an acceptable denomination, comprising a memory means including means for storing predetermined data entries, each acceptable denomination having a first data entry associated therewith, the corresponding first data entries for the respective acceptable denominations forming a first set of data entries, a validation control means operatively connected to said memory means, ringing means operatively connected to said validation control means, said ringing means operable under control of said validation control means to produce damped wave output signals, said ringing means having a field associated therewith and including ring conditioning means and ring reaction means, and means operatively connected to said ringing means to monitor said damped wave output signals produced thereby and to respond to a first particular predetermined damped wave output signal characteristic, said validation control means operable during a coin validation operation with respect to any one of the acceptable denominations to retrieve from said memory means a predetermined data entry associated with such acceptable denomination and stored therein and to produce a conditioning signal corresponding to the retrieved predetermined data entry, said ring conditioning means responsive to such conditioning signal to pre-condition said ringing means in accordance therewith, said validation control means thereafter operable to produce a ring initiation signal, said ring reaction means responsive to such ring initiation signal to produce during a ringing time interval a damped wave output signal the characteristics of which are dependent, in part, both upon the particular pre-condition of said ringing means and upon any coin in the field of said ringing means, the damped wave output signal produced in response to such ring initiation signal for any of said first set of data entries having associated therewith said first particular predetermined damped wave output signal characteristic if a coin of the particular acceptable denomination whose associated data entry was retrieved from memory and utilized to pre-condition said ringing means is in the field of the ringing means during the ringing time interval, regardless of the denomination of the coin submitted to examination or the particular acceptable denomination with respect to which the coin validation operation is conducted.

14. The coin validation means of claim 13 wherein said means operatively connected to said ringing means to monitor each said damped wave output signal includes a detector means operable to produce and to communicate to said validation control means an output signal.

15. The coin validation means of claim 14 wherein said detector means includes amplitude detection means operable to produce a count signal each time a cycle of any damped wave output signal exceeds a predetermined amplitude value, and counter means operatively connected to said amplitude detection means to receive said count signals produced by said amplitude detection means and to enter therein for each damped wave output signal produced a count equal to the number of cycles of the damped wave output signal which exceed said predetermined amplitude value.

16. The coin validation means of claim 15 wherein, for said first set of data entries, the count entered in said counter means as a result of a damped wave output signal is less than a predetermined threshhold count if a valid coin of the particular acceptable denomination whose associated data entry was retrieved from said memory means and utilized to pre-condition said ringing means was in the field of said ringing means during the ringing time interval.

17. The coin validation means of claim 13 wherein said validation control means includes a microprocessor and said detector means includes amplitude detection means operable to produce a count signal each time a cycle of any damped wave output signal exceeds a predetermined amplitude value, said microprocessor responsive to each count signal produced by said amplitude detection means to effect a total count for each respective damped wave output signal of the number of cycles thereof which have exceeded the predetermined amplitude value.

18. The coin validation means of claim 13 wherein each acceptable denomination has a second data entry associated therewith, the corresponding second data entries for the respective acceptable denominations forming a second set of data entries, and wherein said means operatively connected to said ringing means to monitor each said damped wave output signal is responsive to a second particular predetermined characteristic of said damped wave output signal applicable with respect to all of said second set of data entries, the particular damped wave output signal produced in response to any given ring initiation signal for any of said second set of data entries while a coin submitted for examination is in the field of the ringing means having associated therewith said second particular predetermined characteristic if such coin is a valid coin of the particular acceptable denomination whose associated second data entry was retrieved from said memory means and utilized to pre-condition said ringing means, regardless of the denomination of the coin submitted to examination or the particular acceptable denomination with respect to which the coin validation operation is conducted.

19. The coin validation means of claim 18 wherein said means operatively connected to said ringing means to monitor each of said damped wave output signals includes amplitude detection means operable to produce a count signal each time a cycle of any damped wave output signal exceeds a predetermined amplitude value, and counter means operatively connected to said amplitude detection means to receive said count signals produced by said amplitude detection means and to enter therein for each damped wave output signal produced a count equal to the number of cycles of the damped wave output signal which exceed said predetermined amplitude value, and wherein, for said first set of data entries, the count entered in said counter means as a result of a damped wave output signal is less than a predetermined threshhold count if a valid coin of the particular acceptable denomination whose associated first data entry was retrieved from said memory means and utilized to pre-condition said ringing means was in the field of said ringing means during the ringing time interval and, for said second set of data entries, the count entered in said counter means as a result of a damped wave output signal is greater than or equal to a predetermined threshhold count if a valid coin of the particular acceptable denomination whose associated second data entry was retrieved from said memory means and utilized to pre-condition said ringing means was in the field of said ringing means during the ringing time interval.

20. A coin validation means for validating that a coin submitted to examination is a valid coin of an acceptable denomination, comprising memory means including means for storing predetermined data entries, each acceptable denomination having respective corresponding first and second data entries associated therewith, a validation control means operatively connected to said memory means and operable to permit the retrieval from said memory means of the predetermined data entries stored therein, ringing means operatively connected to said validation control means and controllable by said validation control means, said ringing means having a field associated therewith and including ring conditioning means and ring reaction means, said validation control means operable to produce respective conditioning signals corresponding to different predetermined data entries retrieved from said memory means, said ring conditioning means responsive to each conditioning signal to pre-condition said ringing means in accordance therewith, said validation control means operable to produce ring initiation signals, said ring reaction means responsive to each said ring initiation signal to produce a damped wave output signal the characteristics of which are dependent, in part, both upon the particular pre-condition of said ringing means and upon any coin in the field of said ringing means, and detector means operatively connected to said ringing means to monitor each said damped wave output signal, said detector means including an amplitude detection means for producing a count signal each time a cycle of any damped wave output signal exceeds a predetermined amplitude value and counter means operatively connected to said amplitude detection means to receive said count signals produced by said amplitude detection means, said validation control means operatively connected to said counter means and responsive to a count of less than a predetermined count m produced when the first predetermined data entry associated with a particular denomination is retrieved from said memory means and to a count of greater than or equal to the predetermined count m when the second predetermined data entry associated with such particular denomination is retrieved from said memory means to validate the coin submitted to examination.

21. The coin validation means of claim 20 wherein said validation control means includes a microprocessor programmed to test the validity of a given coin with respect to a particular acceptable denomination according to the following steps in a testing routine by (a) retrieving from said memory means the first predetermined data entry associated with such particular denomination,
(b) producing a conditioning signal corresponding to said first predetermined data entry,
(c) generating a ring initiation signal,
(d) checking to determine if the count entered in said counter means is less than predetermined count m, and, if the count is less than m, proceeding to step (e), otherwise, determining that such given coin is not a valid coin with respect to such particular acceptable denomination and exiting said testing routine,
(e) retrieving from said memory means the second predetermined data entry associated with a particular denomination,
(f) producing a conditioning signal corresponding to said second predetermined data entry,
(g) generating a ring initiation signal,
(h) checking to determine if the count entered in said counter means is greater than or equal to a predetermined count m, and, if the count is less than m, determining that such given coin is a valid coin with respect to such particular denomination and exiting said testing routine, otherwise, determining that such given coin is not a valid coin with respect to such particular acceptable denomination and exiting said testing routine of steps.

* * * * *